United States Patent [19]

Rapparini

[11] Patent Number: 4,845,927

[45] Date of Patent: Jul. 11, 1989

[54] PACKAGING MACHINE HAVING INDIVIDUAL CONTROLLED ATMOSPHERE CHAMBER MEANS FOR EACH PACKAGE

[75] Inventor: Gino Rapparini, Bologna, Italy

[73] Assignee: I.C.A. S.p.A., Bologna, Italy

[21] Appl. No.: 143,538

[22] Filed: Jan. 13, 1988

[30] Foreign Application Priority Data

Jan. 21, 1987 [IT] Italy ..... 13326 A/87

[51] Int. Cl.[4] ..... B65B 31/00; B65B 9/10

[52] U.S. Cl. ..... 53/511; 53/86; 53/95; 53/512; 53/575

[58] Field of Search ..... 53/510, 512, 575, 579, 53/511, 551, 89, 91, 95

[56] References Cited

U.S. PATENT DOCUMENTS

| | | | |
|---|---|---|---|
| 2,966,019 | 12/1960 | Grafingholt | 53/512 X |
| 3,006,120 | 10/1961 | Grafingholt | 53/512 X |
| 3,942,301 | 3/1976 | Domke | 53/512 X |
| 3,958,391 | 5/1976 | Kujubu | 53/512 X |
| 4,580,393 | 4/1986 | Furukawa | 53/512 |
| 4,640,081 | 2/1987 | Kawaguchi | 53/510 |

*Primary Examiner*—John Sipos

*Attorney, Agent, or Firm*—Sughrue, Mion, Zinn, Macpeak and Seas

[57] ABSTRACT

In a packaging machine, a plurality of upwardly open receptacles are moved along a first path by a first conveyor and a plurality of packages are formed and inserted into each receptacle respectively. The packages may be filled before or after insertion into the receptacle. A plurality of covers are movable on a second closed path by a second conveyor and are brought into sealed engagement with a respective receptacle to define a sealed chamber. A pressure control device is connected to each chamber by means of a rotatable plenum chamber and a plurality of flexible conduits connected between the rotatable plenum chamber and each sealed chamber. After subjecting the contents of each package to the desired pressure, each package is sealed and subsequently removed from the receptacle.

5 Claims, 10 Drawing Sheets

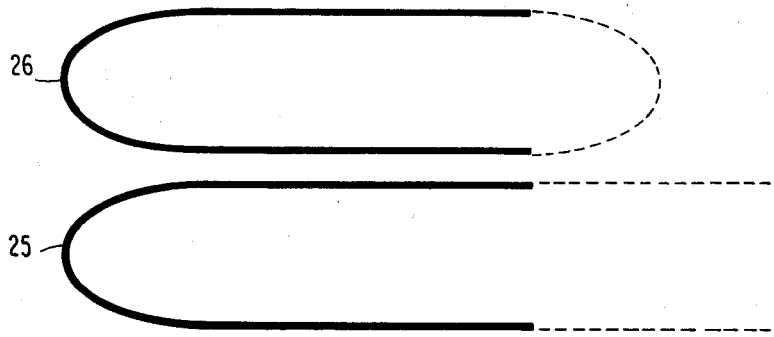
FIG.4
FIG.5
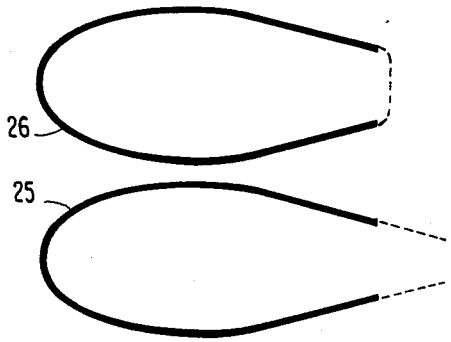
FIG.6
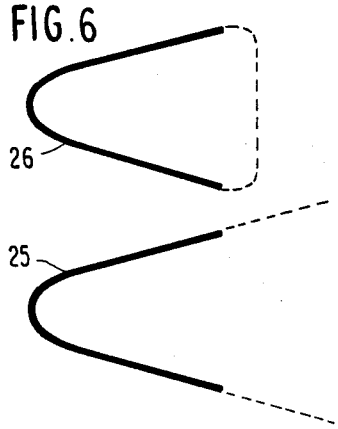
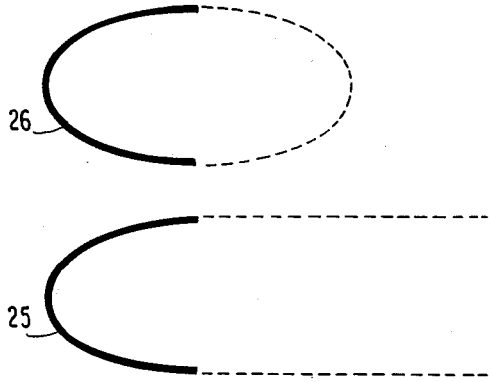
FIG.7
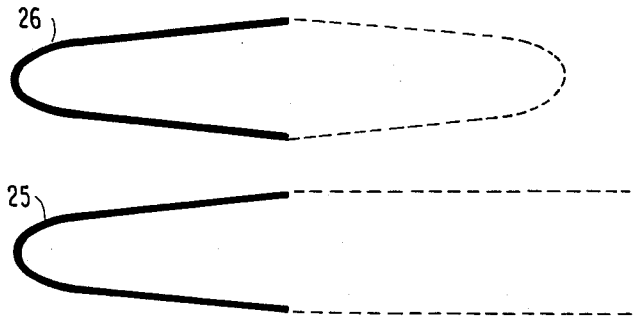
FIG.8

PACKAGING MACHINE HAVING INDIVIDUAL CONTROLLED ATMOSPHERE CHAMBER MEANS FOR EACH PACKAGE

BACKGROUND OF THE INVENTION

The present invention is directed to an automatic packaging machine having individual controlled atmosphere chambers for each package movable along a conveyor and more specifically to controlled atmosphere chamber means comprised of a plurality of package receiving base members movable along a first closed path conveyor and a plurality of covers connected to a common atmosphere controlling means movable along a second closed path partially overlapping the first closed path for sealing engagement with the base members.

It is well known from industrial practice, technical magazines and international patent literature that various packaging machines are provided with means for controlling the atmosphere completely or partially during the package filling and sealing operation. In such machines, the empty bags are transferred from a forming station to a filling conveyor and subsequent to being filled, the bags are transferred into a chamber which is then sealed. The interior of the sealed chamber is then subjecting to a vacuum or other controlled atmosphere depending upon the nature of the packaging operation.

During the transfer of the bags from the forming stations to the filling stations and from there to the controlled atmosphere chambers, numerous disadvantages can arise which would restrict the efficiency of the entire packaging process. There is always the possibility of mishandling the bag during the numerous transfers with the possible consequent spilling of the content of the bag before the bag can be sealed. The frequent transferring of the bag also leads to the possibility of the bunching up of the bags or a jamming of the bags on the various conveyors utilized in the multiple transfer operation.

SUMMARY OF THE INVENTION

The present invention provides a new and improved packaging machine which overcomes all of the shortcomings of the prior art packaging machines by introducing the bags immediately after their formation directly into the base portion of the controlled atmosphere chamber and leaving each bag in the same base member during all subsequent operations before removal as a completely filled sealed bag. Therefore, all possible jamming and mishandling of the bags is prevented.

The present invention provides a new and improved packaging machine having a first endless conveyor movable along a first closed path, a plurality of upwardly open receptacles mounted on the conveyor for movement therewith along said first closed path, bag forming means mounted adjacent said closed path and having means for transferring the formed bag from the bag forming means into an upwardly open receptacle, filling means disposed adjacent to said first endless conveyor means for filling each bag as it moves along said first closed path, second endless conveyor means disposed above said first endless conveyor means for movement along a second closed path partially coincident with said first closed path, a plurality of cover means carried by said second endless conveyor means for movement into sealing engagement with a respective upwardly open receptacle having a filled bag therein to define a sealed chamber, atmosphere controlling means connected to each of said cover means for controlling the atmosphere in each sealed chamber and means for sealing each bag within each chamber and transfer means for removing each sealed bag from a respective receptacle.

The foregoing and other objects, features and advantages of the invention will be apparent from the following more particular description of a preferred embodiment of the invention as illustrated in the accompanying drawings.

BRIEF DESCRIPTION OF THE DRAWINGS

FIGS. 4–8 show different configurations of the first and second conveyor paths with the portions thereof which are adapted to the disposed in coincident overlapping relation shown in heavy solid lines.

DETAILED DESCRIPTION OF THE INVENTION

Figure 1:
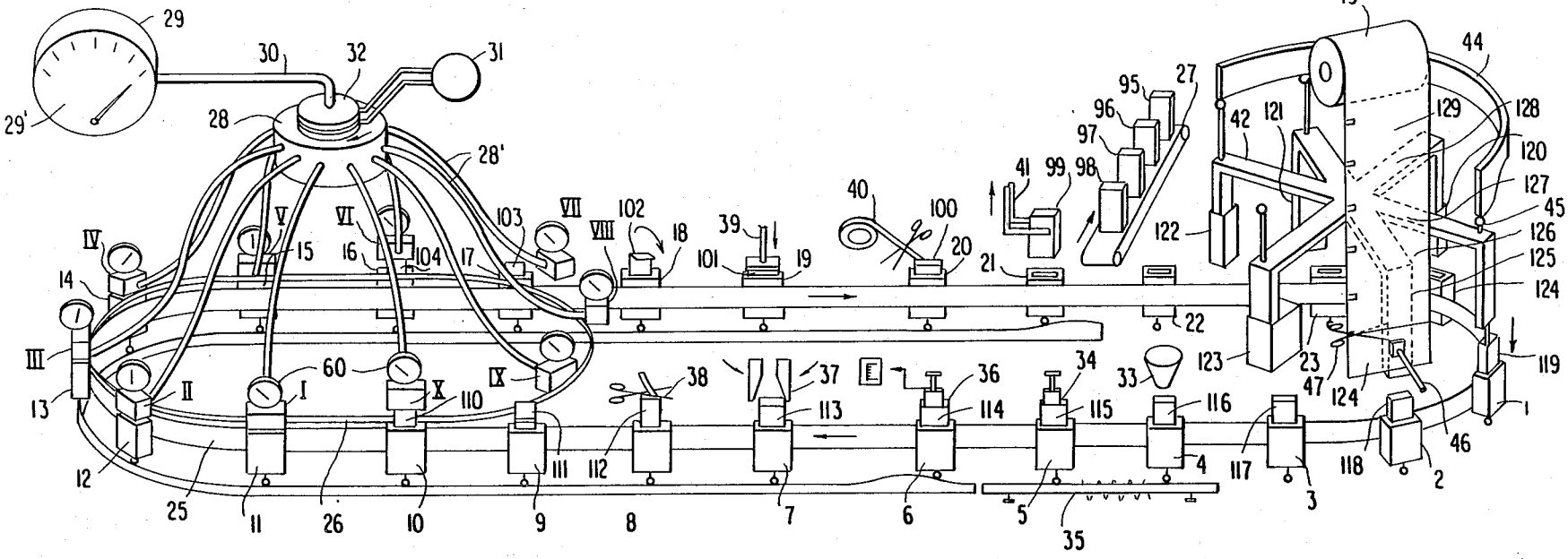
FIG. 1 is a schematic perspective view of the packaging machine according to the present invention showing the specific components of each conveyor in a first position.
Figure 2:
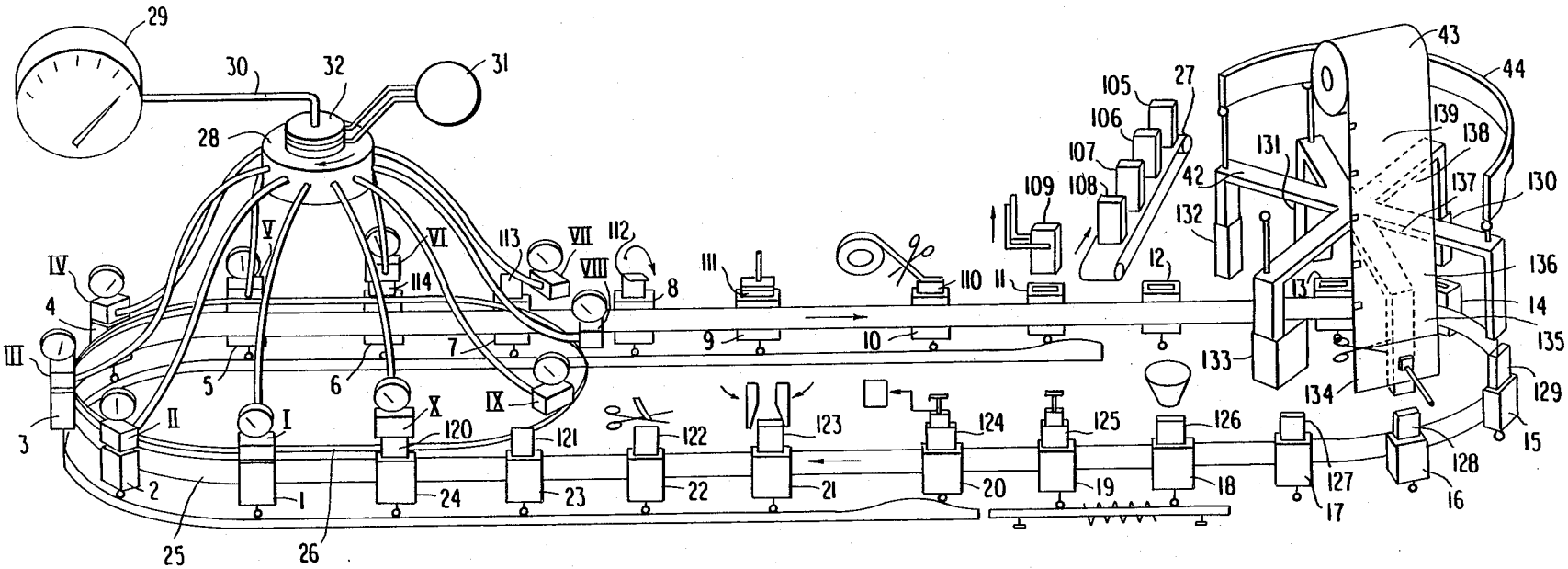
FIG. 2 is a schematic view of the packaging machine according to the present invention similar to that shown in FIG. 1 with the components of the conveyor systems disposed in a second position.
Figure 3:
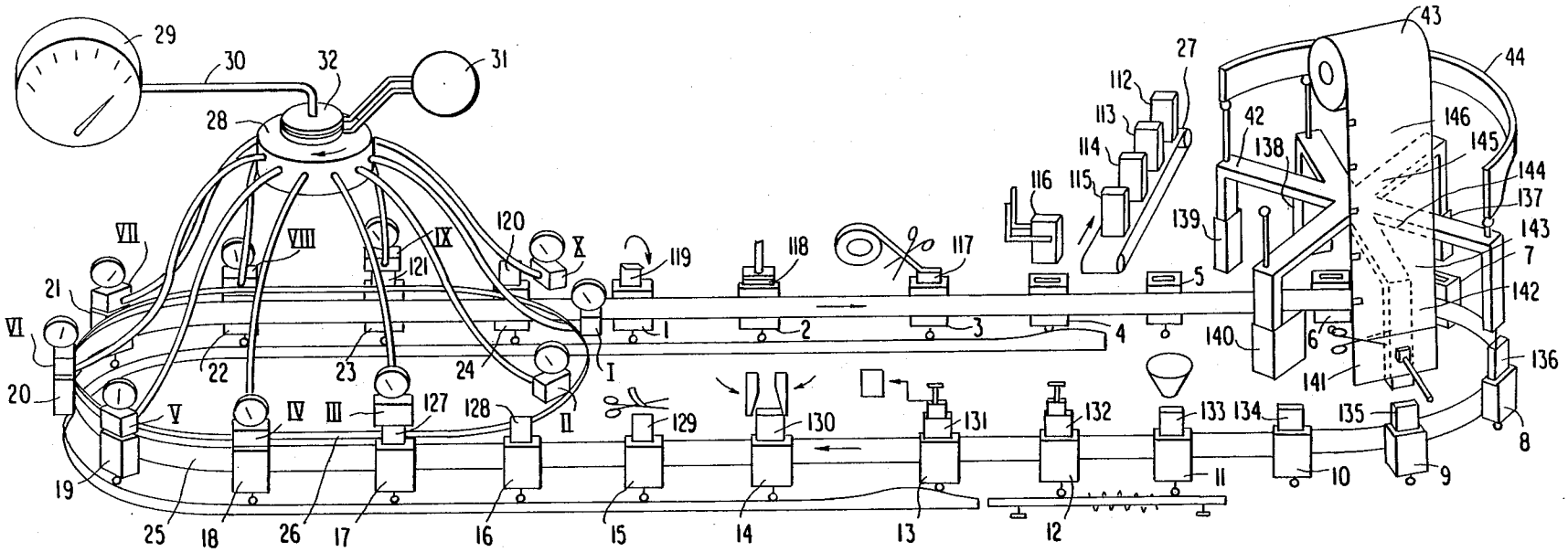
FIG. 3 is a perspective view of the packaging machine according to the present invention similar to that shown in FIG. 2 with the components of each conveyor system and disposed in a third position.
Figure 9:
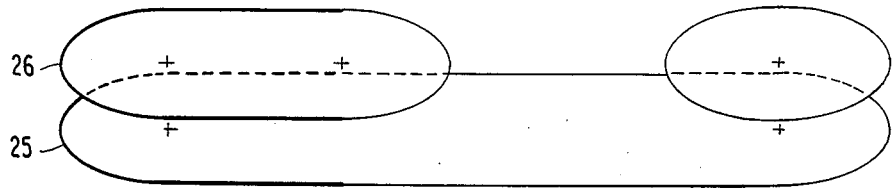
FIGS. 9–13 show a plurality of additional closed path configurations wherein the first and second conveyor means are shown with the coincident overlapping portions shown in heavy solid lines and wherein the path of the bag forming means is shown adjacent the opposite end of the first closed path.
Figure 10:
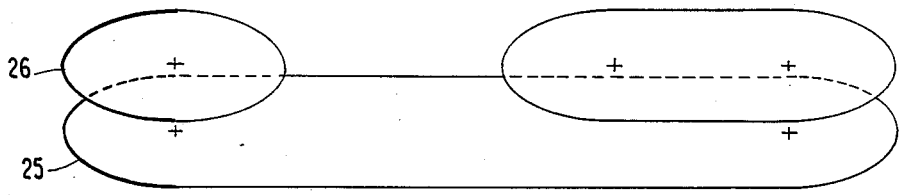
Figure 11:
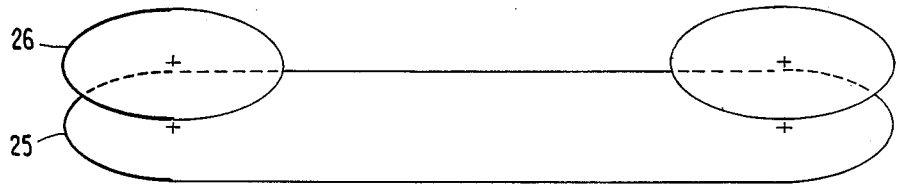
Figure 12:
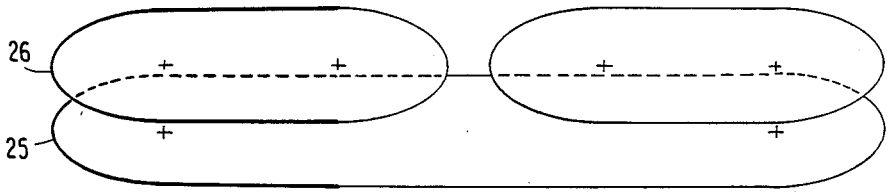
Figure 13:
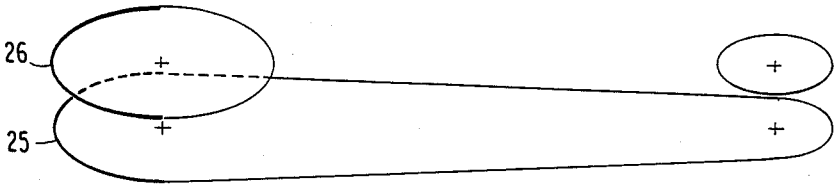

The packaging machine as shown in FIGS. 1–3, inclusive, is comprised of a first endless conveyor 25 and a second endless conveyor 26 disposed in two superimposed parallel planes such that the second endless conveyor 26 is disposed above the first endless conveyor 25 with a substantial proportion of the second conveyor 26 being aligned with the first conveyor 25. The plurality of upwardly open receptacles 1–24 are mounted on the first endless conveyor 25 in equally spaced relation for movement along a first closed path. A plurality of covers for the open receptacles identified by I-X are mounted on the second endless conveyor 26 in equally spaced relation with the spacing between each cover being equal to the spacing between each receptacle on the first endless conveyor 25. A driving arrangement is provided for the conveyors 25 and 26 so as to synchronize the movement of the receptacles 1–24 with the covers I-X upon movement of the covers and receptacles along their respective closed paths. Each cover will be brought into sealing engagement with a respective receptacle to define a sealed chamber therein.

A vacuum pump 29 is connected to a rotatable plenum chamber 28 by means of a pipe 30 and the plenum chamber 28 which is rotatable with the conveyor 26 is connected to each cover I-X by means of a flexible conduit 28'. The vacuum pump 29 is provided with a suitable pressure gauge 29' and each of the sealed chambers defined by the receptacles 1614 24 and covers I-X are provided with a pressure gauge 60.

Sealing jaws (not shown) are located inside each cover member for heat sealing the packages after the chambers have been pressurized to the desired value. The packages are heat sealed by the sealing jaws which are connected by suitable wiring through the flexible conduit 28' to the rotary pulse distributor 32 which in turn in connected by slip rings to a pulse generator 31.

The first conveyor 25 has a generally oblong configuration with the pressure treatment apparatus for the filled bags being located at one curved end of the conveyor. A bag forming apparatus is located at the opposite curved end of the conveyor and is comprised of a rotatable mandrel 42 having a plurality of arms upon which the bag is formed. A supply of flexible film 43 is located above the mandrel, whereby the package forming material is fed vertically downwardly into close proximity with the radial outer face of an arm of the mandrel. The lower end of the sheet material is clamped against the mandrel by means of a clamp 46 and a sheet of material 124 for forming a single package is severed from the remaining sheet supply by means of a cutter 47. The endless sheet supply may be already preprinted with labels for the packages so that the individual sheets 124–129 will be already laid out on the endless sheet supply. Each cut sheet is held on the respective arm of the mandrel by a vacuum system (not shown) so that as the mandrel 42 is rotated, the individual sheets are formed into packages as indicated by the various stages of bag formation 120–123. As shown in FIG. 1, a completely formed bag 119 has been ejected from the mandrel into the receptacle 1 on the conveyor 25 by means of a plunger mechanism 45 controlled by the cam 44. The entire bag forming and ejection apparatus is old and well known in the art and does not form a part of the present invention, but is used in conjunction with the upwardly open receptacles 1–24 inclusive which constitute part of the present invention.

As the conveyor moves the receptacles 1–24 along the closed path, each bag will stop at a filling station 33, whereby the bag is filled with the desired contents. The contents for the present invention may be a loose granular material such as coffee or the like. The filled bag will then move to a tamping station 34, where a tamper will press the filled material firmly into the bag. As the filled bag is moving from the filling station 33 to the tamping station 34, a projection extending from the bottom of the receptacle will pass over a vibrating member in order to vibrate the loose granular material in the package to settle it evenly within the package or bag. The projection extending from the bottom of each receptacle is connected to a movable bottom wall in the receptacle.

The bag then moves to a measuring station 36 having conventional means for measuring the level of the filled material within the bag. The bag will then move to a station 37 having suitable fingers for forming the bellows in the sides of the bag to facilitate a subsequent closing operation. The bag will then move to the next station, wherein a cutter 38 will sever the excess material of the bag.

After these preliminary operations, the bag which is still in the open condition, will move to a station wherein the cover on the second conveyor 26 will be mated with the upwardly open receptacle on the conveyor 25, so as to enclose the filled bag in a sealed chamber. Assuming it is desirable to evacuate the air from the bag prior to sealing the bag, the vacuum pump 29 will be operated to evacuate the air from the sealed chamber having the filled bag therein. As the bag continues its movement on the conveyor 25, the sealing jaws will heat seal the upper ends of the bag. The chamber will subequently be returned to atmospheric pressure and the cover will be separated from the outwardly open mandrel. As indicated by the arrow, the sealed upper end of the bag 102 will then be folded over and upon reaching the station 39, a plunger will press the folded flap against the upper surface of the bag to achieve the final flattening of the bag. At the next station, a tape applying device 40 applies a strip of adhesive tape to hold the flap down against the upper surface of the bag in sealed relation. At the subsequent station, a transfer device 41 will grip the bag 99 and lift it onto a third conveyor 27 for transfer to a suitable packaging station. To facilitate the gripping of the bag 99 by the transfer device 41, the cam track will push the bottom of the upwardly open receptacle upwardly to push the sealed bag further out of the receptacle. The empty receptacle will then continue around the conveyor to receive another empty bag from the bag forming mandrel.

Each of the bags shown in FIG. 1 are numbered consecutively from 95 to 119, while the bags being formed are numbered consecutively from 120 to 124. Additional sheets for forming the bags are illustrated on a sheet supply by the numerals 125–129. In FIG. 2, which is a substantially identical view to FIG. 1, the bags have been moved through ten stations and in FIG. 3 the bags have been moved an additional seven stations. Thus, it is clear that once a bag is formed on a bag forming mandrel, it is transferred into a receptacle and remains in the same receptacle during the entire operation until the completely filled, formed and degassed bag is removed from its receptacle by the transfer device 41.

While a vacuum pump has been illustrated in FIGS. 1–3, it is possible that it may be necessary to subject the filled bag to a pressurized inert gas, in which case a suitable pump could be provided for connection to each of the sealed chambers for carrying out such a pressurizing operation prior to the sealing of the bags within the sealed chamber.

In the examples shown in FIGS. 1–3, the first and second conveyors 25 and 26 both move along closed oblong paths, each having the same curvature at one end so that portions of the two paths may be superimposed on each other. Other forms of paths are shown in FIGS. 4–8 with the portions which will be overlapped shown in heavy solid lines. Still further arrangements of the two conveyors have been illustrated in FIGS. 9–13 with the path of the bag forming apparatus being superimposed at the opposite end of the elongated conveyor path of the first conveyor.

Figure 14:
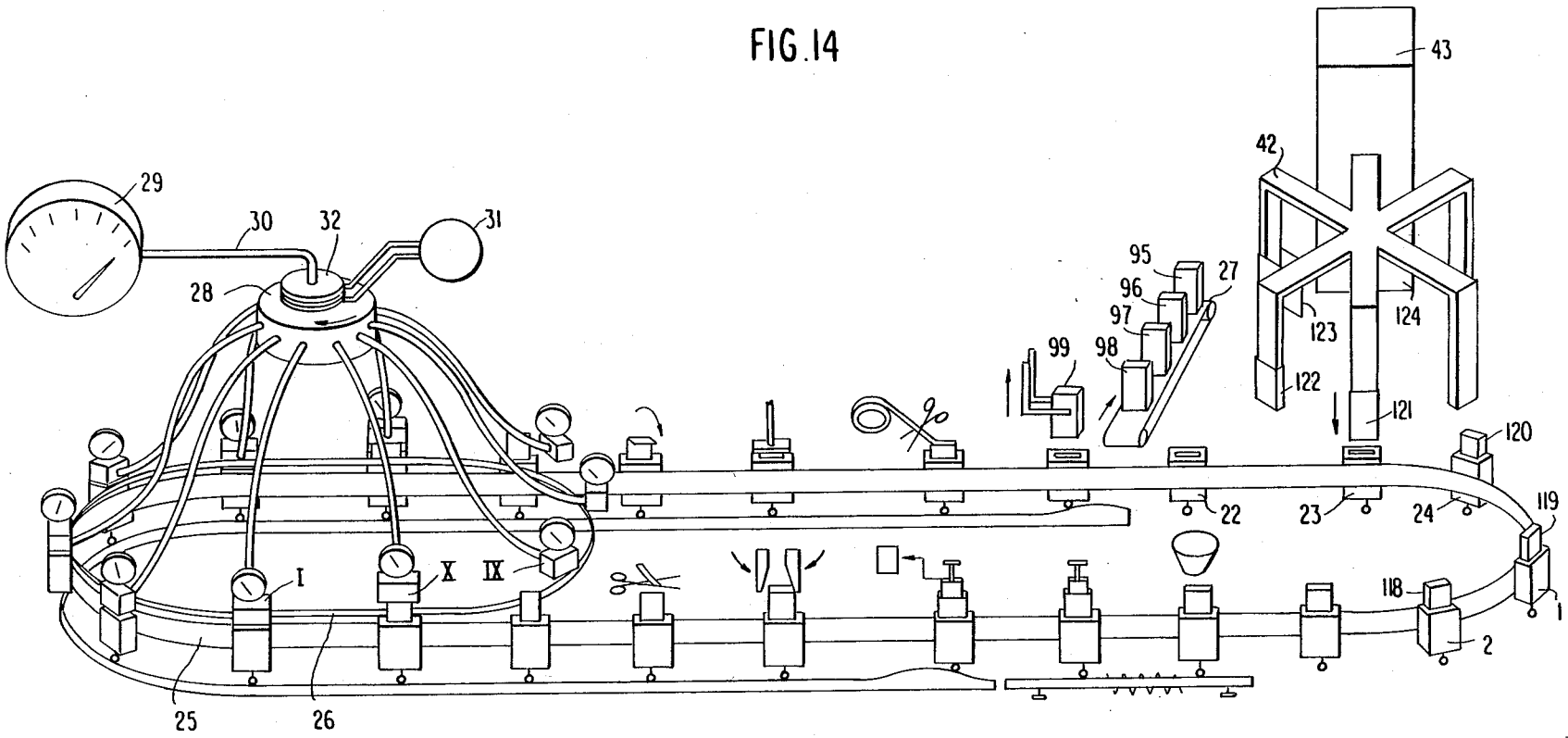
FIG. 14 is a schematic view similar to FIG. 1 but utilizing a second modified bag forming means.

FIG. 14 shows an embodiment similar to FIG. 1 insofar as the arrangement of the first and second conveyors 25 and 26 is concerned, but wherein the bag forming apparatus is offset to one side of the conveyor so that the arm of the mandrel having a completed bag thereon, will come into alignment with an upwardly open receptacle travelling along the first closed path of the first conveyor.

Figure 15:
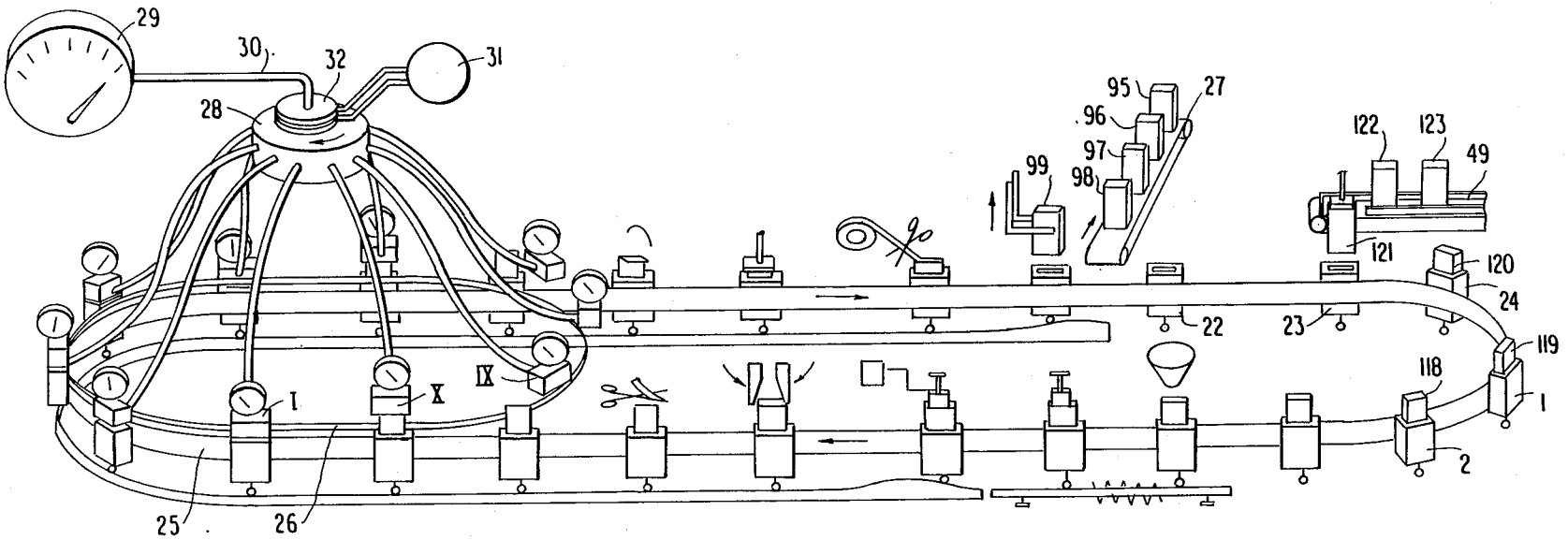
FIGS. 15–18 are schematic views similar to FIG. 1 but utilizing a third, fourth, fifth and sixth modified bag forming means.

The embodiment of FIG. 15 is substantially identical to the embodiment of FIGS. 1–3 insofar as the first and second conveyors 25 and 26 and the associated apparatus are concerned. However, in FIG. 15, the bags are formed by any suitable bag forming apparatus and conveyed along a linear conveyor 49 with the end of the conveyor 49 being aligned with an upwardly open receptacle. Suitable means are provided on the end of the conveyor for transferring an upwardly open bag downwardly into an upwardly open receptacle.

Figure 16:
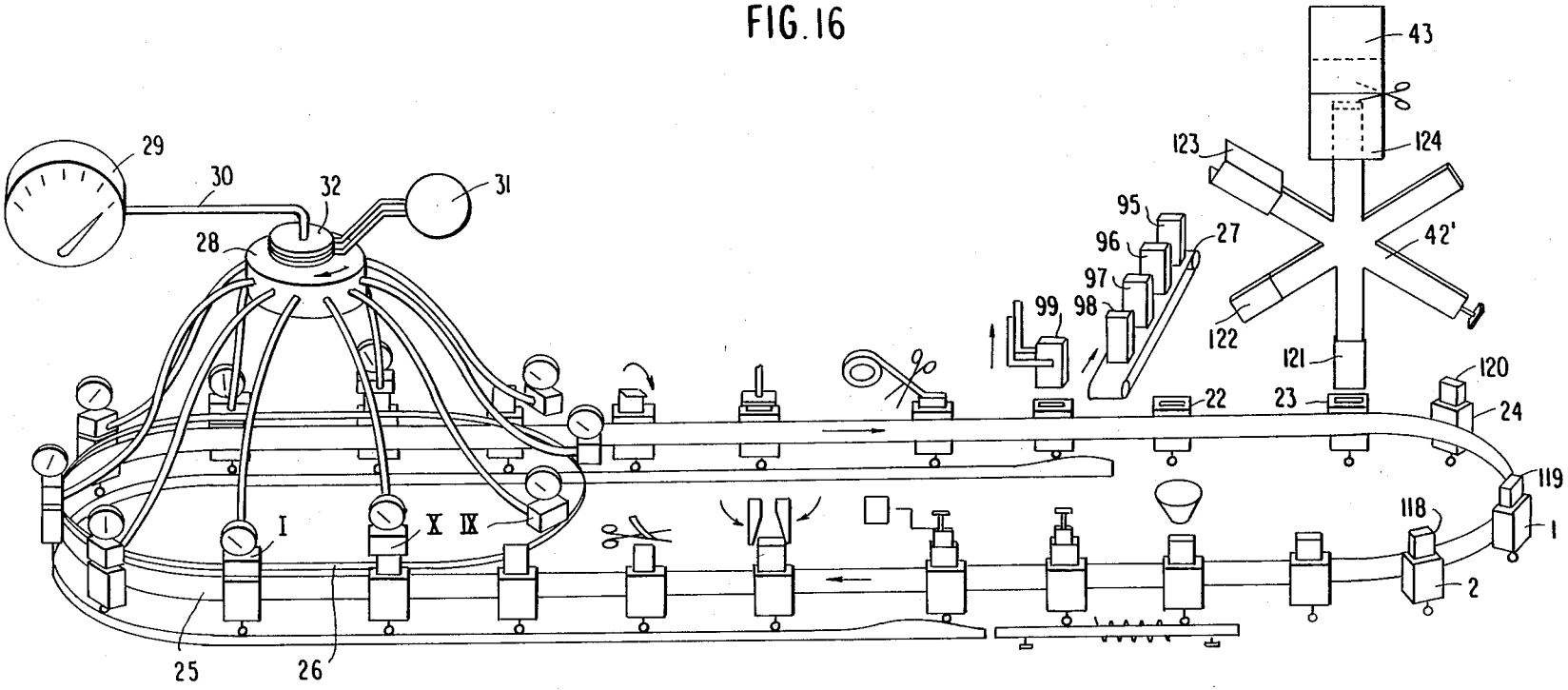

The embodiment of FIG. 16 is similar to the embodiment of FIG. 14 inasmuch as the bag forming is carried out by means of a rotatable mandrel having a plurality of arms. However, the mandrel 42' in FIG. 16 is rotatable by a horizontal axis and is provided with a plurality of bag forming arms which are all located in a common vertical plane disposed above the path of the first conveyor 26. Thus, a completely filled bag will be present on the vertically downwardly extending arm and transfer means are provided within the arm for transferring the formed bag downwardly into the upwardly open receptacle aligned therewith.

Figure 17:
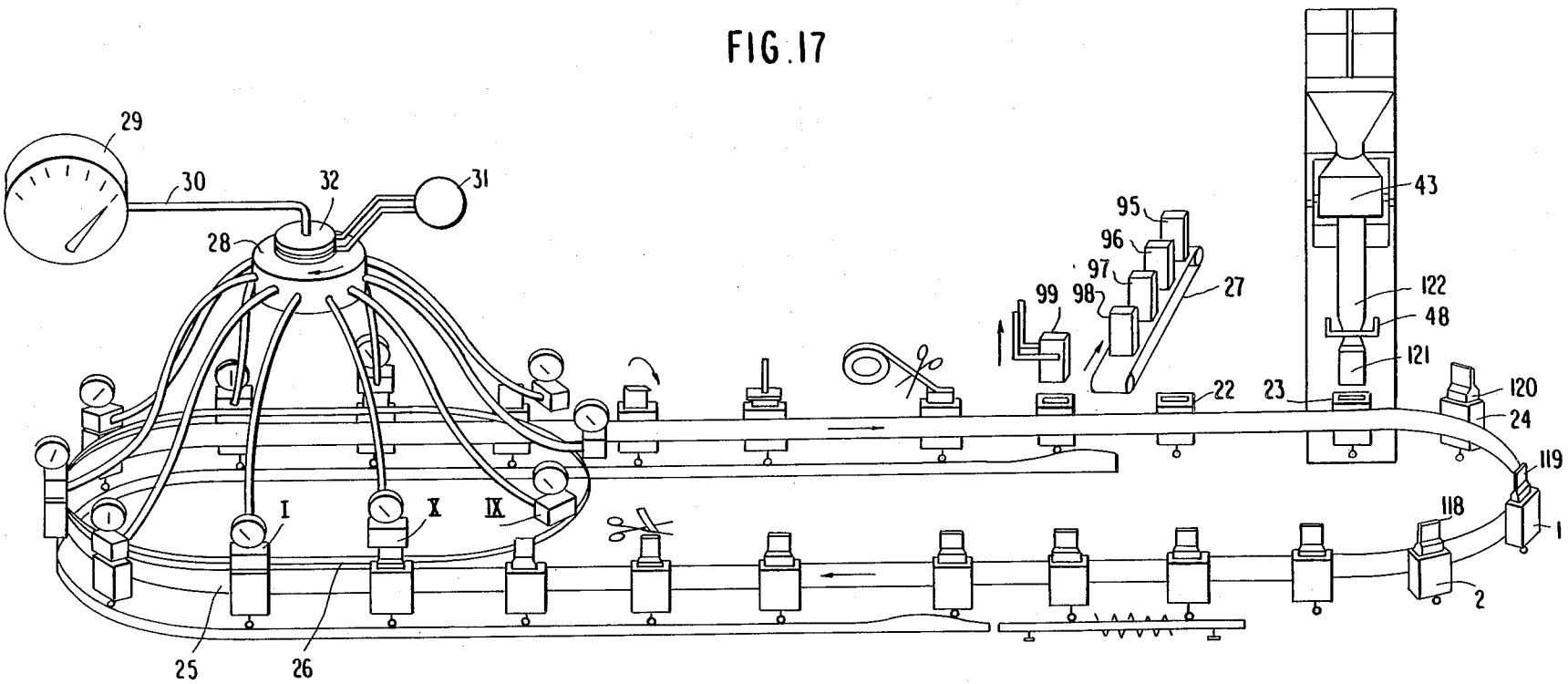

In the embodiment of FIG. 17, the first and second conveyors and the pressure treatment apparatus are substantially identical to all the previous embodiments. However, in this case, a conventional bag forming and filling apparatus 43 is provided wherein the flaps on the upper end of the bag are flattened into engagement with each other by means of a crimping apparatus 48, but the bags are not sealed. The filled bag is then deposited into an upwardly open conveyor, thereby eliminating the need for the filling and level measuring apparatus at subsequent stations. The bags are still vibrated and excess material of the flaps are trimmed off by cutter 38 prior to subjecting the bag to a pressurized treatment.

Figure 18:
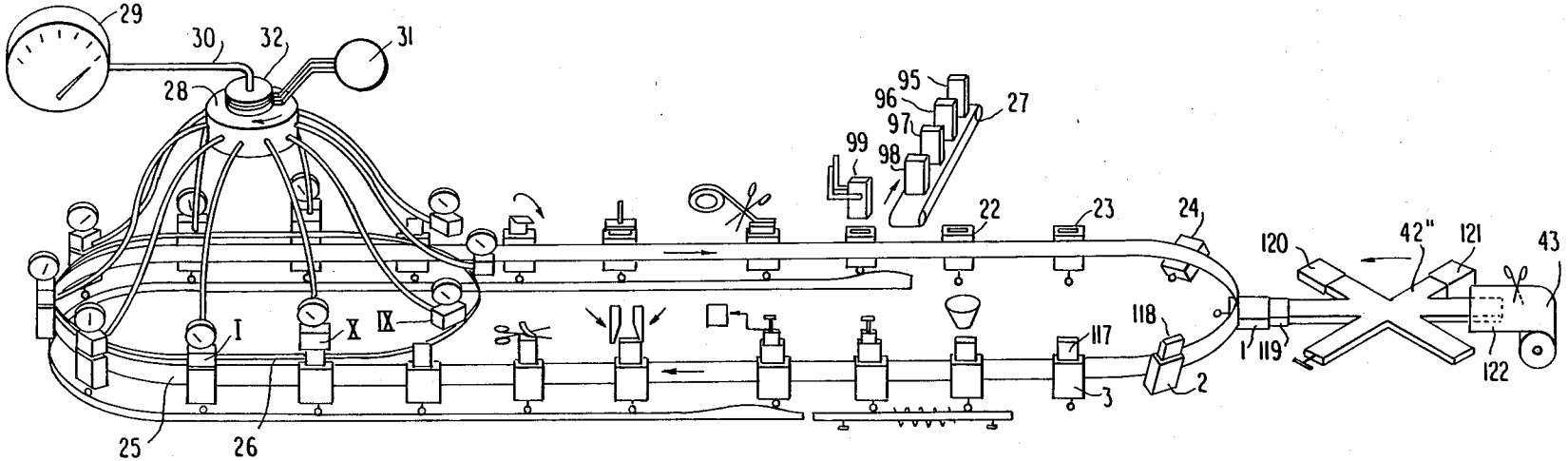

The embodiment of FIG. 18 is similar to the embodiment of FIG. 16, wherein the bag forming apparatus is comprised of a mandrel 42' rotatable about a vertically disposed axis and having a plurality of radially extending arms all disposed in a common horizontal plane. Thus, it is necessary for the first conveyor 25 to have a tilted portion for tilting the receptacles thereon into a horizontal position for insertion of a completed bag from one of the arms of the mandrel 42" into the receptacle. The receptacle having the bag therein is then tilted back to the upright position for all of the subsequent operations previously described.

While the invention has been particularly shown and described with reference to preferred embodiments thereof, it will be understood by those in the art that the foregoing and other changes in form and details may be made therein without departing from the spirit and scope of the invention.

What is claimed is:

1. A packaging machine comprising first conveyor means movable along a first path, a plurality of upwardly open receptacles mounted on said first conveyor for movement therewith along said first path, means for forming and directly inserting a package vertically downwardly into each of said upwardly open receptacles, second conveyor means disposed above said first conveyor means for movement along a second path at least partially coincident with said first path, a plurality of cover means carried by said second conveyor means for movement into sealing engagement with a respective upwardly open receptacle having an open package therein to define a sealed chamber, atmosphere controlling means connected to each of said cover means for controlling the atmosphere in each sealed chamber and means for removing each package from a respective receptacle, wherein said means for forming and directly inserting a package into each of said receptacles includes package forming means comprised of a plurality of vertically disposed mandrels movable about a circular path at least partially coincident with said first closed path, sheet feeding means for supplying package forming material to each mandrel in sequence and means associated with each mandrel for inserting an open package downwardly into each receptacle.

2. A packaging machine as set forth in claim 1, wherein said first and second conveyors are endless conveyors moving along first and second closed paths with said upwardly open receptacles and said cover means being disposed in equally spaced apart relation to ensure mating of said cover means with said receptacles, respectively.

3. A packaging machine as set forth in claim 1, further comprising rotatable plenum means mounted for synchronous movement with said first and second conveyor means, flexible conduit means connected between said plenum chamber and each of said cover means for connecting the interior of the plenum chamber with the interior of each of said sealed chambers and pressure controlling means connected to said plenum chamber for controlling the pressure in each of said sealed chambers.

4. A packaging machine as set forth in claim 1, further comprising means for filling each package in sequence prior to bringing one of said cover means into sealing engagement with a receptacle having a filled package therein.

5. A packaging machine as set forth in claim 1, wherein said means for forming and directly inserting a package into each upwardly open receptacle includes means for forming, filling and partially closing each package prior to insertion into a respective receptacle.

* * * * *